United States Patent [19]

Yamaguchi et al.

[11] 4,036,043

[45] July 19, 1977

[54] EXTRUSION DIE FOR HOT HYDROSTATIC EXTRUSION OF ALUMINUM AND ALUMINUM ALLOYS

[75] Inventors: Yoshihiro Yamaguchi, Ashiya; Tomiharu Matsushita; Masataka Noguchi, both of Nishinomiya; Hideaki Ide; Kunihiko Nishioka, both of Kobe, all of Japan

[73] Assignee: Kobe Steel Ltd., Kobe, Japan

[21] Appl. No.: 623,631

[22] Filed: Oct. 20, 1975

[30] Foreign Application Priority Data

Oct. 18, 1974 Japan ..... 49-119924

[51] Int. Cl.[2] ..... B21C 3/10; B21C 9/00; B21C 23/32; B21C 25/02

[52] U.S. Cl. ..... 72/41; 72/60; 72/272; 72/467; 72/DIG. 31

[58] Field of Search ..... 72/60, 41, 467, 272, 72/DIG. 31; 425/461

[56] References Cited

U.S. PATENT DOCUMENTS

| | | | |
|---|---|---|---|
| 1,582,434 | 4/1926 | Simons | 72/41 |
| 3,583,204 | 6/1971 | Nilsson | 72/467 |
| 3,756,054 | 9/1973 | Nilsson | 72/60 |
| 3,817,069 | 6/1974 | Hauser et al. | 72/60 |
| 3,886,775 | 6/1975 | Korsell et al. | 72/60 |

*Primary Examiner*—Othell M. Simpson
*Assistant Examiner*—Horace M. Culver
*Attorney, Agent, or Firm*—Oblon, Fisher, Spivak, McClelland & Maier

[57] ABSTRACT

A die for use in a hot hydrostatic extrusion process, in which a billet comprised of aluminum or an aluminum alloy or a billet having aluminum and an aluminum alloy at its outer periphery is preheated and charged into a container whereupon extrusion is carried out by means of a pressure medium, said die comprising a plurality of stepped conical portions serving as approach portions to the die outlet; said conical portions having conical surfaces whose opening angles increase from the inlet of the die toward the outlet thereof, said conical surface which is closest to said inlet having an opening angle of less than 60 degrees, and the difference between the opening angles between adjacent conical surfaces being less than 90 degrees.

9 Claims, 15 Drawing Figures

EXTRUSION DIE FOR HOT HYDROSTATIC EXTRUSION OF ALUMINUM AND ALUMINUM ALLOYS

BACKGROUND OF THE INVENTION

1. Field Of The Invention

The present invention relates to a die useful in hot hydrostatic extrusion of aluminum and aluminum alloys.

2. Description Of The Prior Art

As is well known, it is common practice to form aluminum and aluminum alloys into end products by use of a non-lubricating extrusion process such as direct or indirect extrusion in a temperature range between 350° and 500° L C. In these extrusion processes, a specifically designed die such as a bridge die or a port-hole die has heretofore been used for performing extrusion of pure aluminum and Al-Mg alloys into end products having various structural profiles, including simple or complex profiles at a relatively high speed. If, however, a high tensile strength aluminum alloy such as Al-Cu alloy is extruded at such a high speed, the end products are formed with many cracks even when the end products have simple profiles. Thus, the extrusion speed must be limited to a lower level, viz., 2 to 3 m/min. The cracks are caused primarily by a partial temperature rise in the products due to friction between the die surface and the products, as well as by lack of uniformity in the strain and stress distributions caused by the flat die. It will thus be seen that while the conventional direct or indirect extrusion of aluminum or aluminum alloys has reached a highly skilled level there still remain many unsolved problems caused by the friction inherent in such non-lubricating extrusion processes.

On the other hand, the hydrostatic extrusion process, which is a most excellent lubricating extrusion technique, eliminates these problems. In this process, a pressure medium consisting of a material having a high lubricity and good pressure transmittance is introduced into a container and provides a fluid film between the billet and the die thereby reducing friction therebetween. Thus, a high tensile strength aluminum alloy such as an Al-Cu alloy can be extruded in a cold state at a high speed of several hundreds of meters per minute.

The present inventors have conducted many experiments involving hydrostatic extrusion, both hot and cold, of various materials in order to improve the workability of the process.

From these experiments, the existence of several surprising phenomena have been discovered in the hot hydrostatic extrusion process, particularly when aluminum and aluminum alloys are extruded. Namely, the extrusion pressure is determined by the flow stress of the billet material and the extruding ratio. Consequently, it is possible to increase the extruding ratio using the same extruding pressure if metals such as copper, aluminum and aluminum alloys are extruded in the hot hydrostatic extrusion process because the flow stress of the copper and aluminum is decreased as the extruding temperature is increased. Experiments have been conducted using particular materials such as copper, aluminum and aluminum alloys having the property that the flow stress decreases with increasing extruding temperature.

These experiments have revealed that non-sticky materials such as copper can be hot extruded even when the extrusion is performed by using a conical die similar to that used in the cold hydrostatic extrusion process. However, it is impossible to apply the same die for extruding aluminum and aluminum alloys without the occurrance of many seizures and dead metal areas. Consequently, there still exists a need for a hot extrusion die which allows for satisfactory extrusion of aluminum and aluminum alloys.

SUMMARY OF THE INVENTION

Accordingly, it is an important object of the present invention to provide an improved die for use in a hot hydrostatic extrusion process which die is capable of preventing seizures and formation of dead metal that would otherwise occur during the hot hydrostatic extrusion of aluminum and aluminum alloys.

Briefly, this and other objects of this invention, as will hereinafter become clear from the ensuing discussion, have been attained by providing a die for use in a hot hydrostatic extrusion process, in which a billet comprised of aluminum or an aluminum alloy or a billet having aluminum and an aluminum alloy at its outer periphery is preheated and charged into a container whereupon extrusion is carried out by means of a pressure medium, said die comprising a plurality of stepped conical portions serving as approach portions to the die outlet; said conical portions having conical surfaces whose opening angles increase from the inlet of the die toward the outlet thereof, said conical surface which is closest to said inlet having an opening angle of less than 60 degrees, and the difference between the opening angles of adjacent conical surfaces being less than 90 degrees.

BRIEF DESCRIPTION OF THE DRAWINGS

A more complete appreciation of the invention and many of the attendant advantages thereof will be readily attained as the same becomes better understood by reference to the following detailed description when considered in connection with the accompanying drawings, wherein.

DESCRIPTION OF THE PREFERRED EMBODIMENTS

Figure 1:
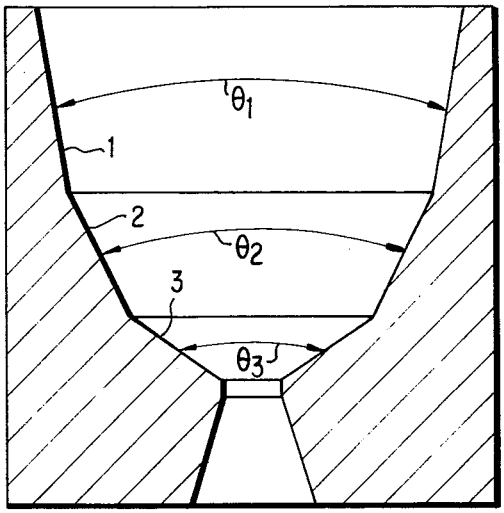
FIG. 1 is a longitudinal sectional view of a preferred embodiment of a die according to the present invention.

Dead metals are usually formed in an extrusion process when the lubrication is insufficient and the metal flow does not occur uniformly such as in conventional ram type extrusion. When aluminum and aluminum alloys are extruded by hot extrusion, the flow stress of the hot billet material becomes lower than that of the other materials and slippage is caused in the billet when the friction at the die surface is larger than the internal flow stress. Thus, seizures and the presence of dead metals are caused in the surface layer during extrusion. In view of this, the present invention provides a die for such a hot hydrostatic extrusion by combining at least two conical surfaces, one of which, near the entrance of the die, is angled to a small degree to promote a wedge effect on the lubricant, thereby preventing the formation of dead metal, and the other one of which is angled to a larger degree to prevent the formation of seizures by the creation of a pool of the pressure medium. More specifically, since the lubrication is sufficient in a hydrostatic extrusion, it is usual practice to employ a conical die in place of a flat die. These conical dies usually are angled at between 45° and 90° and are used in both cold and hot hydrostatic extrusions.

As previously mentioned above, even when such a die is used in a hot hydrostatic extrusion of aluminum or aluminum alloys, the formation of seizures and dead metal cannot be prevented. Thus, commercially acceptable end products cannot be obtained.

The formation of dead metal in heat extrusion poses a serious problem, as follows:

While in the prior art ram-type extrusion process dead metal is also formed in the end product, the influence of the dead metal on the surface quality is practically negligible. If, however, dead metal is produced in the end product extruded by hot hydrostatic extrusion, the end product cannot be used, since if the dead metal is produced at the entrance of the die, the end product becomes covered with a thin film made of dead metal. These thin films become peeled off from the surface of the end product. As a result, it is impossible to obtain products having accurate outer diameters.

These deleterious phenomena occur because of the fact that aluminum and aluminum alloys have flow stresses lower than those of other materials and, consequently, shearing deformation is caused in the internal portion of the billet during extrusion. This phenomenon is particularly serious as the extrusion temperature increases. In order to solve this problem, it is necessary to improve the metal flow and the lubrication. Thus, it may be possible to prevent the formation of seizures and dead metal by covering the billet with a strong lubricating film which can be used at high temperatures. However, it is very difficult to find a suitable lubricant having a suitably high thermal resistance and a low cost. Even if such a material were discovered, a problem would still remain in that the material to be extruded would have to be treated with a lubricating material thus requiring additional work time.

In accordance with an essential feature of the present invention, there is provided a die for use in hot hydrostatic extrusion in which a billet consisting of aluminum or an aluminum alloy, or a billet including at its outer periphery aluminum or an aluminum alloy, is preheated and charged into a container whereupon the billet is hydrostatically extruded by means of a viscous pressure medium also charged into the container. The die is comprised of the combination of at least two conical surfaces which constitute a multi-stage conical configuration in which the opening angles of the respective conical surfaces increase from the inlet toward the exit of the die, and in which the opening angle of the conical surface closest to the inlet of the die is less than 60°, and in which the difference between the opening angles of adjacent conical surfaces is less than 90°.

Referring now to FIG. 1, there is shown a preferred embodiment of the die of the present invention. As shown, the die is comprised of the combination of three conical surfaces 1, 2 and 3. Assuming that the opening angles of the conical surfaces 1, 2 and 3 are $\theta 1$, $\theta 2$ and $\theta 3$, respectively, the following relationships hold:

| | |
|---|---|
| $\theta 1 < \theta 2 < \theta 3$ | (1) |
| $\theta 2 - \theta 1 < 90°$ | (2) |
| $\theta 3 - \theta 2 < 90°$ | (3) |
| $\theta 1 < 60°$ | (4) |

From the above it will be seen that the opening angles, $\theta 1$, $\theta 2$ and $\theta 3$, are so determined to satisfy the above relations.

Figure 2A:
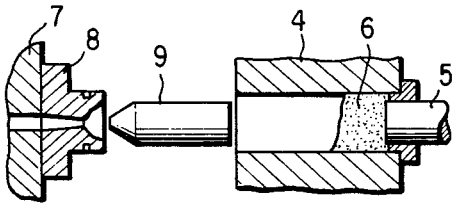
FIGS. 2*a* through 2*c* are sectional views illustrating typical sequential steps of the hot hydrostatic extrusion process.
Figure 2B:
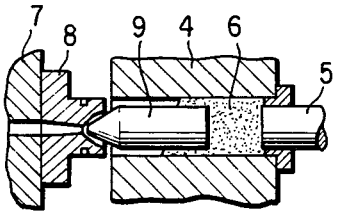
Figure 2C:
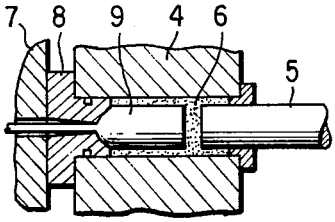

FIG. 2 illustrates a peferred embodiment of a hot hydrostatic extrusion apparatus employing a die of the present invention. FIGS. 2(*a*) to 2(*c*) show the sequence of the steps in the hot hydrostatic extrusion process using a viscous pressure medium such as graphite grease. FIGS. 2(*a*) to 2(*c*) show a container 4 in which a stem 5 is slidably disposed.

Referring to FIG. 2(*a*) which shows a pressure medium 6 being supplied, a billet 9 is positioned between the container 4 and a die 8 supported by a die holding fixture 7 so that the preheated billet 9 is axially aligned with the opening of the container 4 in which the viscous pressure medium 6 is already supplied.

FIG. 2(*b*) shows the insertion of a billet, in which the container 4 and the stem 5 are moved forward so that the billet 9 is inserted into the container 4. In this instance, the pressure medium 6 begins to form around the outer periphery of the billet 9 as the billet 9 advances within the container 4. When the die 8 is disposed in the container 4, the container 4 is sealed by a high pressure packing mounted on the outer periphery of the die 8. Under these circumstances, one end of the billet 9 engages with a conical portion of the die 8.

FIG. 2(*c*) shows the extrusion step in which the stem 5 is moved forward to compress the pressure medium 6 so that the billet 9 is extruded through the opening of the die 8 under the hydrostatic pressure of the pressure medium 6.

It will thus be appreciated that the die of the present invention shown in FIG. 1 is used in the hot hydrostatic extrusion shown in FIG. 2. The essential features of the present invention will be subsequently described in detail with reference to FIGS. 3 to 6.

Figure 3:
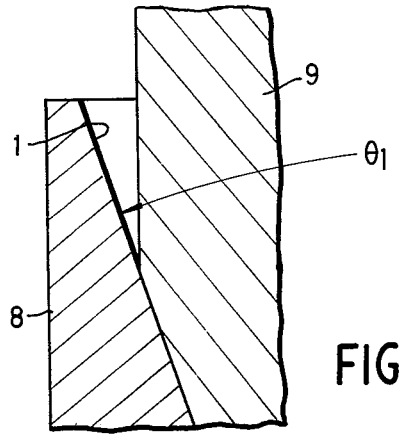
FIGS. 3 through 6 are sectional views illustrating the relationship between the die and the billet.

Referring to FIG. 3 which shows the relationship between the conical surface 1 closest to the inlet of the die 8 and the billet 9, the conical surface 1 is formed such that the opening angle $\theta 1$ is less than 60° to provide a wedge effect to allow the high pressure medium to penetrate between the billet 9 and the die 8. When the high pressure medium is effectively caused to penetrate between the billet and the die, it provides a thick fluid film therebetween, minimizing the friction between the billet 9 and the die 8. Furthermore, the opening angle of the conical surface 1 closest to the inlet of the die 8 is selected to be the smallest so that the friction between the conical surface 1 of the die 8 and the billet 9 is small whereby the generation of heat at the point of contact is eliminated and, as a result, the formation of dead metal is prevented. Repeatedly conducted experiments have revealed that the above result is remarkable, particularly when the opening angle of the conical surface 1 closest to the inlet of the die 8 is less than 60°, preferably within a value between 20° and 45°.

Figure 4:
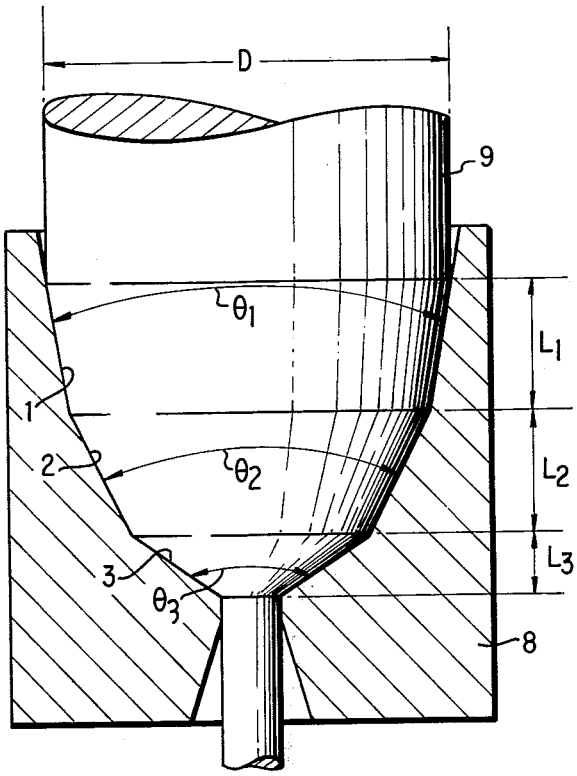

FIG. 4 illustrates the relationship between the billet 9 and the die 8 during extrusion. In FIG. 4, the diameter (D) of the billet 9 and the lengths (L1, L2, and L3) of the conical surfaces 1, 2 and 3, respectively, which the billet 9 contacts, are all shown. The conical surfaces are formed such that the opening angles $\theta 1$, $\theta 2$ and $\theta 3$ satisfy the relationships (1) through (4) mentioned above. In the die of the present invention, if the projected length of each of the conical surfaces which the billet 9 contacts is essentially large, seizures will be formed on the contacting areas of the billet 9. However, tests have revealed that, in order to prevent seizures, the following relation must be met:

$$L/D < 1.5 .$$

If the die meets all of the above requirements, local generation of heat at the discontinuous portions of the conical surfaces will be effectively prevented and the lubricating film will be satisfactorily maintained between the billet 9 and the die 8 so that seizures can be effectively prevented.

Figure 5:
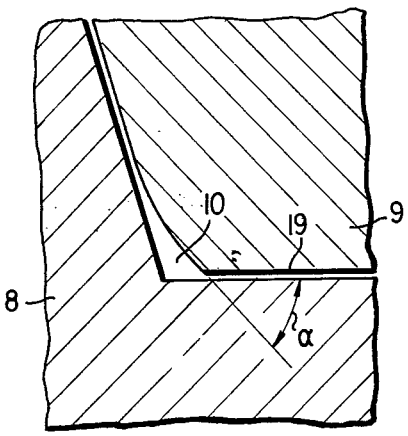

Referring to FIG. 5, which shows in section an enlarged discontinuous cross-sectional portion of the die 8, there is indicated a pool of the pressure medium fluid 10. If, in this instance, the tangential angle $\alpha$ of the metal flow of the billet with respect to the conical surface is selected to be a low value, preferably below 5 degrees, the pressure medium in the pool 10 is caused to be effectively dragged between the billet 9 and the die 8 thereby providing a thick film of lubricant therebetween to prevent the formation of seizures.

Explaining in detail, the pressure medium which is at a high pressure at the inlet of the die 8 is caused to be dragged between the billet and the die thereby forming a thick film of fluid lubricant therebetween. In this instance, the billet is advanced from the inlet of the die toward the exit or the opening thereof so that the cross-sectional area of the billet is decreased and the surface area of the billet in a constant volume increases. Assuming that the diameter of the billet is Do and the diameter of an arbitrary portion of the conical surfaces of the die is D, the following relationship holds:

$$, S = So \cdot Do/D$$

where S is the surface area of the billet during extrusion and So is the surface area of the billet before extrusion. From the above equation, it will be seen that the thickness of the pressure medium dragged from the inlet of the die will be changed to the thickness $h = ho \cdot D/Do$ at the position of the die having the diameter D. If the thickness of the lubricating film is kept large, the billet is prevented from directly contacting the die surface so that a material in which seizures may be likely to occur, such as aluminum alloys or titanium, can be satisfactorily extruded into desirable end products. To this end, the thickness $h$ of the lubricating film should be maintained larger than the surface roughness of the material to be extruded.

Figure 6:
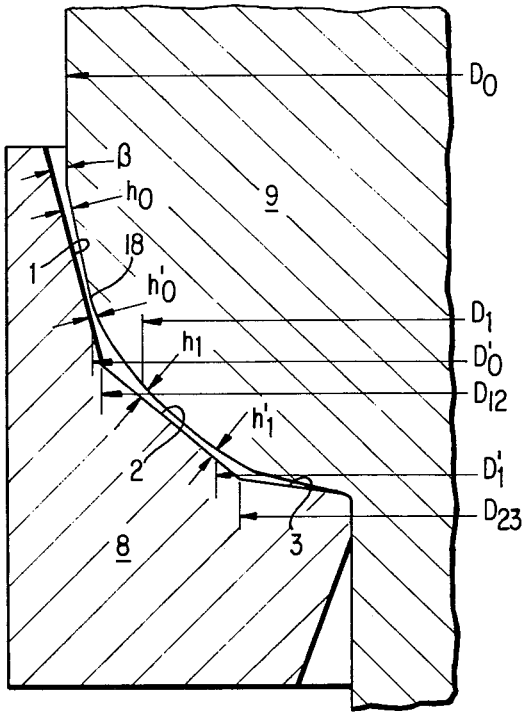

In accordance with the present invention, the die is provided with a stepped approach portion of the die, allowing the formation of pools in which the pressure medium or the lubricating medium remains, whereby the thickness of the lubricating film between the billet and the die surface is maintained to be larger than a predetermined value. These pools are formed in the die approach portion in the manner as shown in FIG. 6. In FIG. 6, if the pressure medium is dragged between the billet 9 and the die 8 at a wedge angle of $\beta°$, the thickness of the pressure medium will be decreased in the manner as mentioned above. The thickness $ho$ varies in dependence upon the angle $\beta$ at the inlet, the advance speed of the billet and the viscosity of the pressure medium. Tests have revealed that the thickness $ho$ has a value of 5 to 10 micrometers. In order to prevent the billet from directly contacting the die surface at the deformation area thereof, it is required that the lubricating film be maintained at a thickness of about 5 micrometers and, to this end, the following equation should be satisfied:

$$\frac{Do'}{Do} = \frac{ho'}{ho}, \frac{D_1'}{D_1} = \frac{h_1'}{h_1}$$

Using the symbols in FIG. 6, the following relationships hold:

$$Do' < \left(\frac{ho'}{ho}\right) Do = (1.0 - 0.5)\, Do \tag{5}$$

$$D_1' < \left(\frac{h_1'}{h_1}\right) D_1 = (1.0 - 0.5)\, D_1 \tag{6}$$

If the above relationships are met, it is possible to maintain the pressure medium or the lubricating film at a given thickness between the billet and the deformation area of the die so that the extrusion can be completed without causing any seizures on the product surface.

Turning now to FIGS. 5 and 6, if the difference between the opening angle of a given conical surface and that of an adjacent conical surface is larger than the prescribed angle, the billet is caused to directly contact the die surface. As a result, the lubrication will be poor in the following surface 19. In order to provide pools of the lubricating medium, it is preferred that the conical surfaces are formed such that the opening angles $\theta 1$, $\theta 2$ and $\theta 3$ meet the relations (1) to (4) mentioned above and that the value of $D_{12}/Do$ near the inlet of the die be larger than the value of $D_{23}/D_{12}$.

It will now be understood that the die of the present invention includes a die approach portion comprised of stepped conical surfaces having different opening angles. While the present invention has been shown and described with reference to a specific embodiment in which three conical surfaces are provided, it should be noted that various other changes and modifications may be made. For example, the die may be comprised of an approach portion having two conical surfaces. If, in this case, the first conical surface is angled at 20° to 45°, and the second conical surface is angled at 90° to 120°, it is possible to prevent the formation of seizures and dead metal in the material.

Having generally described the invention, a more complete understanding can be obtained by reference to certain specific examples, which are provided herein for purposes of illustration only and are not intended to be limiting unless otherwise specified.

EXAMPLE 1

Conventional Extrusion

Figure 7:
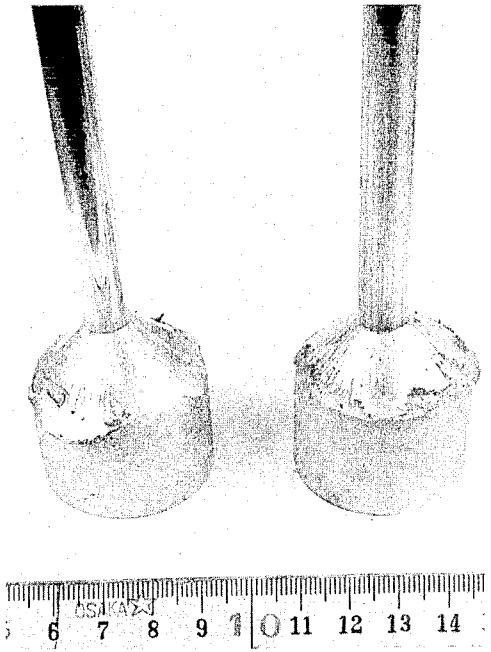
FIGS. 7 and 8 are views illustrating the outer appearance of products formed with dead metal and the longitudinal section of a deformed portion of a material, respectively.
Figure 8:
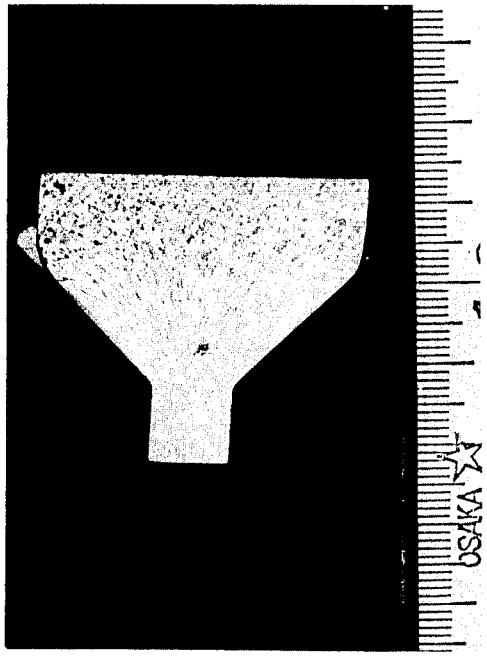

No. 5 056 Al-alloy was first preheated to a temperature of 300° C and thereafter placed between a container and conventional die comprised of a single conical surface angled at 90°. The material was subjected to hot hydrostatic extrusion at an extrusion ratio of 16 and $L_1/D = 0.75$, as shown in FIG. 4, and at an extrusion ratio of 25 and $L_1/D = 0.80$ thereby producing products. The billets were formed with dead metal thus providing the poor surface appearance shown in FIG. 7. A section of the billet is shown in FIG. 8.

EXAMPLE 2

Conventional Extrusion

No. 2 024 Al-alloy was preheated to a temperature of 300° C and subjected to hydrostatic extrusion through an extrusion die provided with a single conical surface angled at 45° while maintaining the extrusion ratio at 60 and $L_1/D = 0.895$. The billet was not formed with dead metal, but seizures occurred at the position near the opening of the die.

EXAMPLE 3

Required Relationship Not Satisfied

Figure 9:
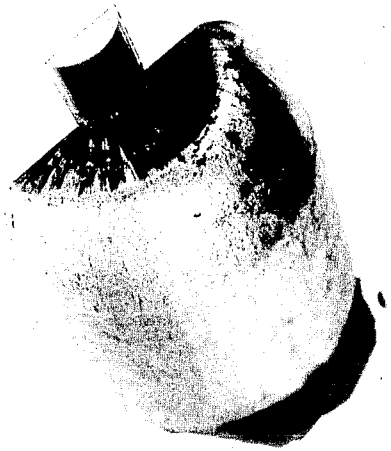
FIG. 9 is a view illustrating the outer appearance of a product having seized portions.

No. 2 024 Al-alloy was heated to a temperature of 300° C and subjected to hot hydrostatic extrusion through an extrusion die including a die approach portion comprised of three conical surfaces angled at 20°, 45° and 180° in which $L_1/D = 0.3$, $L_2/D = 0.15$ and $L_3/D = 0$. The extrusion ratio was 16. Dead metal was not formed, but seizures appeared on the periphery of the billet near the surface angled at 180°, as shown in FIG. 9.

EXAMPLE 4

Figure 10:
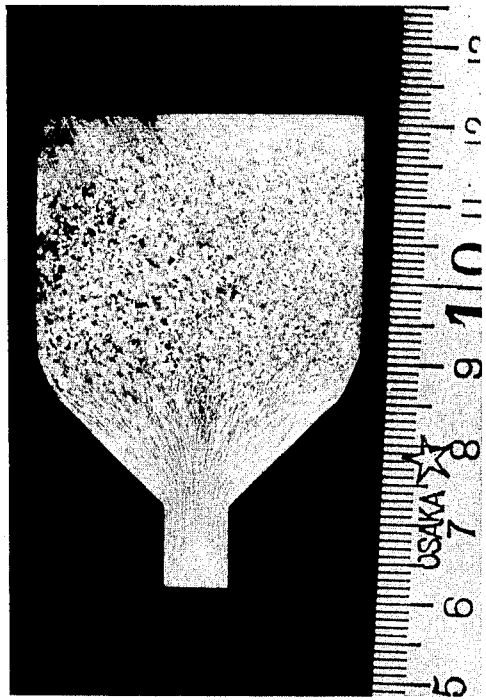
FIGS. 10 and 11 are views illustrating a section of a deformed portion of a product obtained by the die of the present invention, and the outer appearance of the product, respectively; and, FIGS. 12 and 13 are sectional views illustrating other preferred embodiments of the die of the present invention.

No. 5 056 Al-alloy was heated to a temperature of 300° C and subjected to hot hydrostatic extrusion through an extrusion die including an approach portion comprised of two conical surfaces angled at 45° and 90° in which $L_1/D = 0.15$ and $L_2/D = 0.34$. The extrusion ratio was 25. Neither dead metal nor seizures were formed as shown in FIG. 10.

EXAMPLE 5

Figure 11:
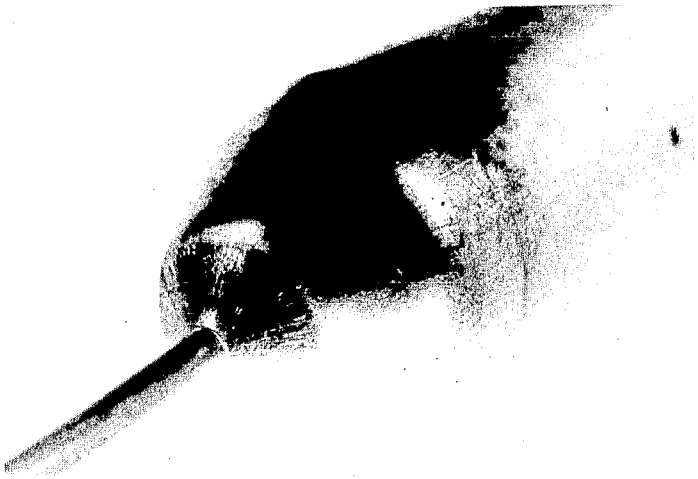

No. 5 056 Al-alloy was heated to a temperature of 350° C and subjected to hot hydrostatic extrusion through an extrusion die including an approach portion comprised of three conical surfaces angled at 20°, 60° and 120° in which $L_1/D = 0.29$, $L_2/D = 0.35$ and $L_3/D = 0.11$. The extrusion ratio was 80. The extruding speed was maintained at 200 m/min, thereby producing a sound product of a good quality. Dead metal and seizures were not found as shown in FIG. 11.

EXAMPLE 6

No. 2024 Al-alloy was heated to a temperature of 350° C and subjected to hot hydrostatic extrusion through an extrusion die including an approach portion comprised of two conical surfaces angled at 10° and 60° in which $L_1/D = 1.33$ and $L_2/D = 0.17$. The extrusion ratio was 2.7. Formation of dead metal and seizures was not present.

EXAMPLE 7

No. 2024 Al-alloy was heated to a temperature of 350° C and subjected to hot hydrostatic extrusion through an extrusion die including an approach portion comprised of four conical surfaces angled at 20°, 60°, 120° and 180° in which $L_1/D = 0.26$, $L_2/D = 0.36$, $L_3/D = 0.08$ and $L_4/D = 0$. The extrusion ratio was 100. The approach portion of the die was comprised of a first section made of tool steel in which the first, second and third conical surfaces were angled at 20°, 60° and 120°. The approach portion was further comprised of a second section made of sintered carbide in which the fourth conical surface was angled at 180°. The extrusion was carried out at a speed of 250 m/min and a good product without seizures and dead metal was obtained.

The above Examples 1 and 2 represent unsuccessful attempts. From these failures, it can be seen that dead metal may be prevented by decreasing the opening angle of the conical surface of the die thereby reducing the wedge angle between the billet and the die so that the pressure medium or lubricant can be dragged between the die to a larger degree thereby improving the lubricating effect. However, if the extruding die is comprised of an approach portion having a single conical surface, the contacting area between the billet and the die increases and, thus, the extrusion pressure must be increased resulting in the formation of seizures due to excessive temperature rises. Example 3 also represents an unsuccessful case. In this test, the difference between the opening angles of the adjacent conical surfaces was too large so that a large change of direction of the metal flow occurred during the extrusion and, as a result, a partial temperature rise was caused. Various tests have revealed that if the opening angles of the respective conical surfaces are different from each other by an angle less than 90°, the angle between the direction of metal flow and the conical surface, as shown in FIG. 5, is approximately zero; while when the difference between the opening angles of the respective conical surfaces reaches 120°, the angle $\alpha$ rapidly increases to from 16° through 25°.

As is now apparent from the above Examples, if the die includes an approach portion having a conical surface angled at a suitably small degree and another conical surface whose opening angle differs from the opening angle of the first conical surface by a suitable degree, it is possible to perform a hot hydrostatic extrusion of aluminum or an aluminum alloy in a satisfactory manner. Tests reveal that if the extuding die is comprised of an approach portion including stepped conical portions whose opening angles increase from the inlet toward the outlet of the die and if the conical surface closest to the inlet of the die is angled at a value below 60° and the difference between the respective opening angles of adjacent cones is below 90°, then hot hydrostatic extrusion can be performed in an effective manner providing end products of high quality.

The reason why the opening angle of the conical surface closest to the inlet of the die must be below 60° and the difference between the opening angles of adjacent conical surfaces must be below 90° has already been explained with reference to FIGS. 3 through 6. In order to cause the pressure medium serving as a lubricating medium to be dragged between the billet and the die, it is required that the conical surface near the inlet of the die be angled at a value below 60°. In order to reduce the sudden changes in the direction of metal flow and prevent a partial temperature rise, the difference between the opening angles of adjacent conical surfaces must be below 90°. Preferably, the relationship between the length L of the conical surface with which the billet comes into contact and the diameter D of the billet satisfy the relationship $L/D < 1.5$. If such a die is used for performing a hot hydrostatic extrusion, desirable results will be obtained without formation of seizures and dead metal. If the above requirements are satisfied, various changes may be made in the extrusion ratio and the material to be extruded. In addition, the number of conical surfaces in the die may be more than two and, in this case, a satisfactory result will also be obtained especially where the extrusion ratio is high as seen in Example 5. It may also be understood that while the extrusion die may have a sharp edge portion between the approach portion and the die opening, the die may also preferably have a curved portion having a suitable radius of curvature between the approach portion and the die opening.

Figure 12:
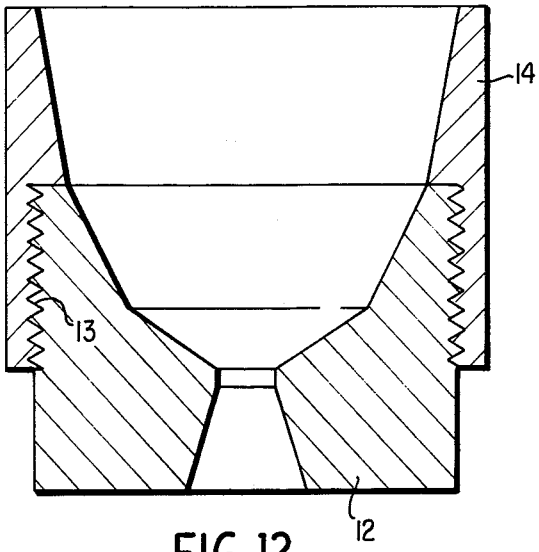
Figure 13:
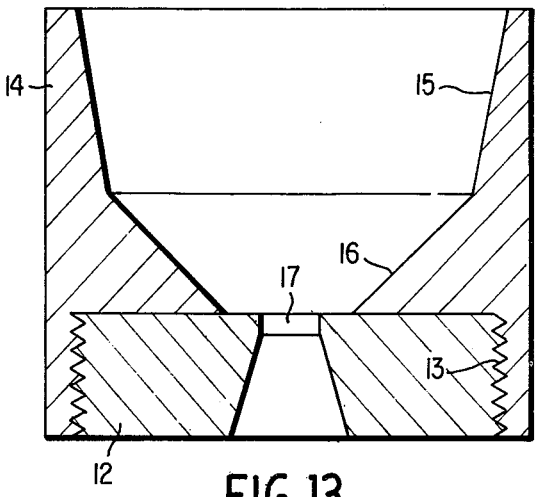

It should further be noted that is is possible to change the approach portion of the die in accordance with the extrusion ratio and types of the aluminum alloy to be extruded by replaceably mounting a guide section 14 onto a threaded portion 13 of a main die portion 12 which guide section has a conical surface angled at suitable degrees as shown in FIG. 12. The extrusion die of the present invention may further be modified in a manner as shown in FIG. 13. In this modification, the die comprises a guide section 14 having conical approach portions 15 and 16, and a main die portion 12 threaded into the guide section 14. The main die section 12 is flat and has a die opening 17. This modification is advantageous in that there are several main die sections having various shaped die openings, respectively, which die sections may be easily replaced.

It will now be appreciated from the foregoing description that in accordance with the present invention it is possible to perform hot hydrostatic extrusion of aluminum and aluminum alloys at considerably higher speeds and higher extrusion ratios as compared to the prior art ram-type extrusion or cold hydrostatic extrusion process. Furthermore, products having high quality and improved surface appearances without the formation of seizures and dead metal can be obtained. Thus, the present invention is highly meritorious for industrial purposes.

Having now fully described the invention, it will be apparent to one of ordinary skill in the art that many changes and modifications can be made thereto without departing from the spirit or scope of the invention as set forth herein.

What is claimed as new and intended to be covered by Letters Patent is:

1. A die for use in a hot hydrostatic extrusion process, in which a billet comprising aluminum or an aluminum alloy or a billet having aluminum and an aluminum alloy at its outer periphery is preheated and charged into a container whereupon extrusion is carried out by means of a pressure medium, said die having a inlet portion and an outlet portion and comprising:

a plurality of contiguous stepped conical portions serving as approach portions to said die outlet;

said conical portions having conical surfaces whose opening angles increase from said inlet of said die toward said outlet thereof, said conical surface which is closest to said die inlet having an opening angle of less than 60°, and the difference between the opening angles between adjacent conical surfaces being less than 90°;

said conical surface closest to said die inlet defining an open area into which said pressure medium may be initially introduced between said conical surface closest to said die inlet and said billet; and said contiguous conical surfaces define annular pockets between said contiguous conical portions and said billet for housing pools of said pressure medium;

whereby during said extrusion, said pressure medium enters the area defined between said billet and said conical surface closest to said die inlet so as to prevent the formation of dead metal and is also extracted from said pockets so as to enter the area defined between said billet and said conical surfaces so as to lubricate said billet thereby preventing seizure thereof within said die.

2. The die of claim 1, made of plural parts which are separately formed.

3. The die of claim 1, including a sharp edge portion defined between the last one of said die approach portions and said die outlet portion.

4. The die of claim 1, including a curved portion between the last one of said die approach portions and said die outlet portion.

5. The die of claim 2, in wich the die outlet section and said die approach portions are made of the same material.

6. The die of claim 2, in which the die outlet section and said die approach portions are made of different materials.

7. The die of claim 6, in which the die outlet sections is made of sintered carbide and said die approach portions are made of tool steel.

8. The die of claim 1, wherein the opening angle of the conical surface closest to the inlet of the die is between 20° and 45°.

9. The die of claim 1, wherein $L/D < 1.5$, where D is the diameter of said billet and L is the projected length of each of the conical surfaces.

* * * * *